United States Patent [19]

Bass

[11] 4,317,304

[45] Mar. 2, 1982

[54] RANGE AND ELEVATION ADJUSTMENT FOR TELESCOPIC SIGHT

[76] Inventor: James S. Bass, 6009 McGregor Blvd., Fort Myers, Fla. 33901

[21] Appl. No.: 109,325

[22] Filed: Jan. 3, 1980

[51] Int. Cl.[3] ..... F41G 1/38

[52] U.S. Cl. ..... 42/1 ST; 33/247

[58] Field of Search ..... 42/1 ST; 33/245-248

[56] References Cited

U.S. PATENT DOCUMENTS

| | | | |
|---|---|---|---|
| 465,088 | 12/1891 | Patchen | 33/247 |
| 1,084,848 | 1/1914 | Demele | 42/1 ST |
| 3,340,614 | 9/1967 | Leatherwood | 33/246 |

FOREIGN PATENT DOCUMENTS

| | | | |
|---|---|---|---|
| 449748 | 7/1948 | Canada | 42/1 ST |

*Primary Examiner*—Charles T. Jordan
*Attorney, Agent, or Firm*—Harvey B. Jacobson

[57] ABSTRACT

A telescopic sight, mount and actuator therefor is provided for a long gun or other weapon capable of projecting a missile therefrom along a trajectory path in predetermined orientation relative to the weapon. The actuator and mount include coacting components whereby elevation adjustment of the telescopic sight relative to the weapon and focusing of the telescopic sight enables the optical axis of the sight, at any given focused range, to intersect with the point along the trajectory path of the missile at the same range distance from the weapon. The actuator includes an operator portion closely adjacent a handgripped area of the weapon whereby the operator portion may be readily adjusted as the weapon and telescopic sight are brought to bear and focus, respectively, on the target.

7 Claims, 6 Drawing Figures

RANGE AND ELEVATION ADJUSTMENT FOR TELESCOPIC SIGHT

BACKGROUND OF THE INVENTION

Various weapons including firearms (long guns in particular) are at least occasionally equipped with telescopic sights and the mounting portions of such telescopic sights are provided with adjustment features whereby the telescopic sight may be "zeroed in" at a predetermined range distance. However, if a person using a weapon equipped with a telescopic sight desires to aim at a target disposed at a different distance from the weapon, the person operating the weapon must compensate for the difference in the target range distance and sight "zeroed in" distance. Such compensation is often difficult to quickly accomplish, and is many times impossible, within the short period of time available due to the fact that the difference between the "sighted in" range of the telescopic sight and the target range cannot always be accurately determined. Accordingly, a need exists for a telescopic sight and mounting therefor whereby proportional "elevation" adjustments of the telescopic sight may be made simultaneously with the focusing thereof in order that the range adjustment (focusing) of the telescopic sight along the optical axis of the telescopic sight will coincide with the same range (distance) along the trajectory path of a projectile from the associated weapon.

Various forms of telescopic sights have heretofore been developed such as those disclosed in U.S. Pat. Nos. 1,084,848, 2,266,331, 2,425,130, 2,516,347, 3,023,503, 3,506,330 and 3,737,232, but none of these previously known sights has included a single "near trigger" actuator for similtaneous focusing and elevational adjustment for a given projectile trajectory.

BRIEF DESCRIPTON OF THE INVENTION

The telescopic sight and mount therefor include means for simultaneously effecting "elevational" adjustment of the telescopic sight and focusing adjustment thereof. Further, the simultaneous adjustment of the "elevation" of the sight and focusing of the sight is proportionally effected (in accordance with the established projectory of the ammunition to be utilized in the associated gun) such that adjustment of the focus of a telescopic sight will automatically adjust the "elevation" thereof so that the point of focus along the optical axis of the telescopic sight will substantially coincide with the point along the trajectory of the bullet fired by the gun at the same range distance from the gun. In this manner, a person using the associated gun will be assured that the target upon which he precisely focuses and centers with respect to the optical axis of the telescopic sight will be struck by the bullet fired from the associated gun, at least in the absence of lateral wind forces.

However, it is noted that modifications in the elevation adjustment mechanism of the telescopic sight will be required when ammunition having a different trajectory is to be used in the gun. Notwithstanding, the elevation mechanism of the instant invention is constructed in a manner whereby different contoured components thereof may be alternately utilized to "tailor" the elevation adjusting mechanism with the trajectory of a particular ammunition to be utilized in the associated gun.

The main object of this invention is to provide a telescopic sight for a weapon including means for projecting a missile therefrom along a trajectory path in predetermined orientation relative to the weapon and with the focusing and elevational adjustment of the telescopic sight coacting in a manner whereby the point of focus of the telescopic sight along the optical axis thereof will coincide with the trajectory of the projectile to be fired from the gun at the same range distance.

Another object of this invention is to provide a telescopic sight which may be utilized on handguns and long guns as well as other weapons such as conventional, compound and crossbows.

Still another important object of this invention is to provide a telescopic sight in accordance with the preceding objects and whose focusing and "elevation" adjustment structure may be readily modified in accordance with a given trajectory of a given missile to be projected from the weapon.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
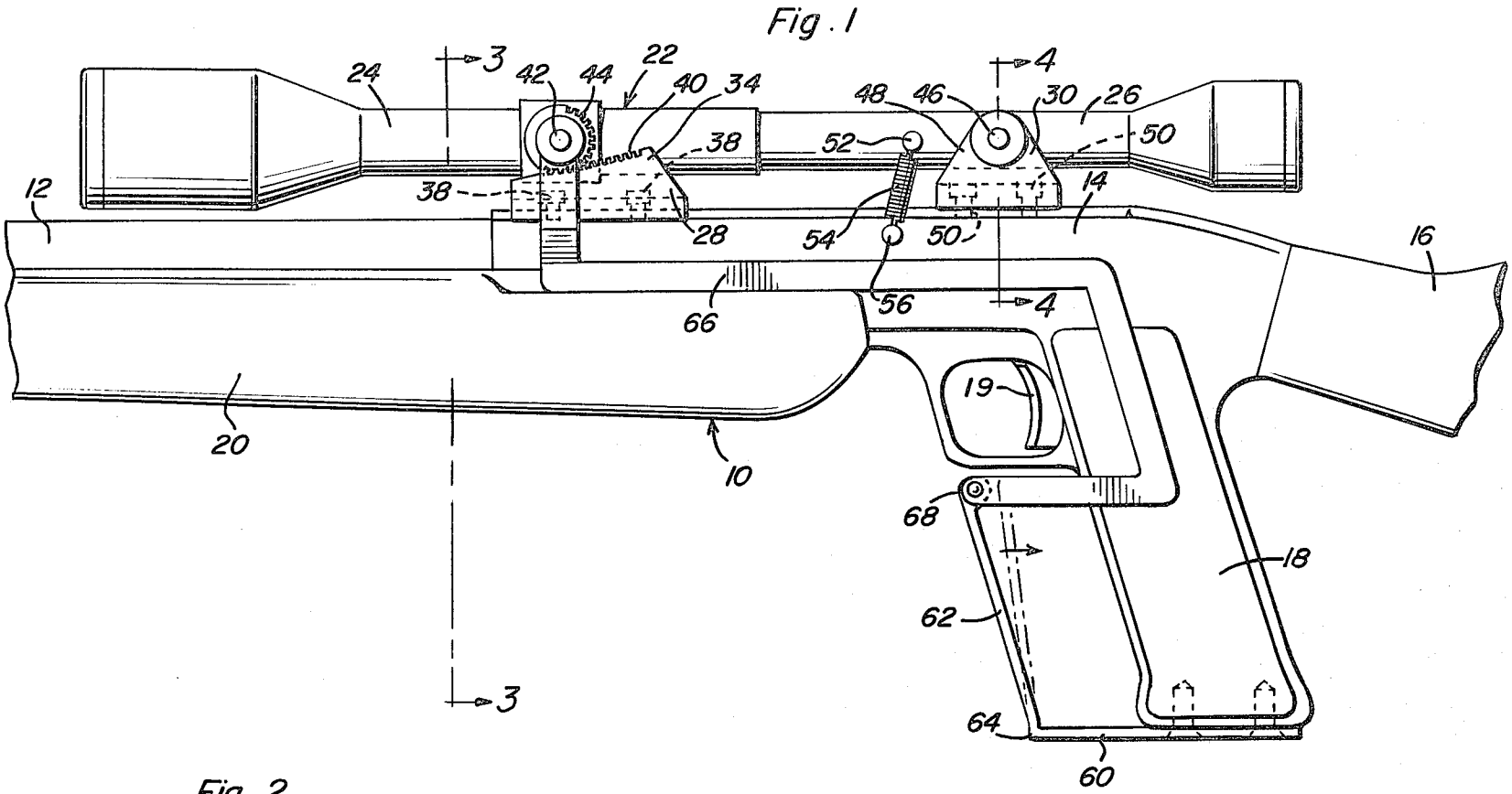
FIG. 1 is a fragmentary side elevational view of the telescopic sight of the instant invention operatively associated with a long gun.
Figure 2:
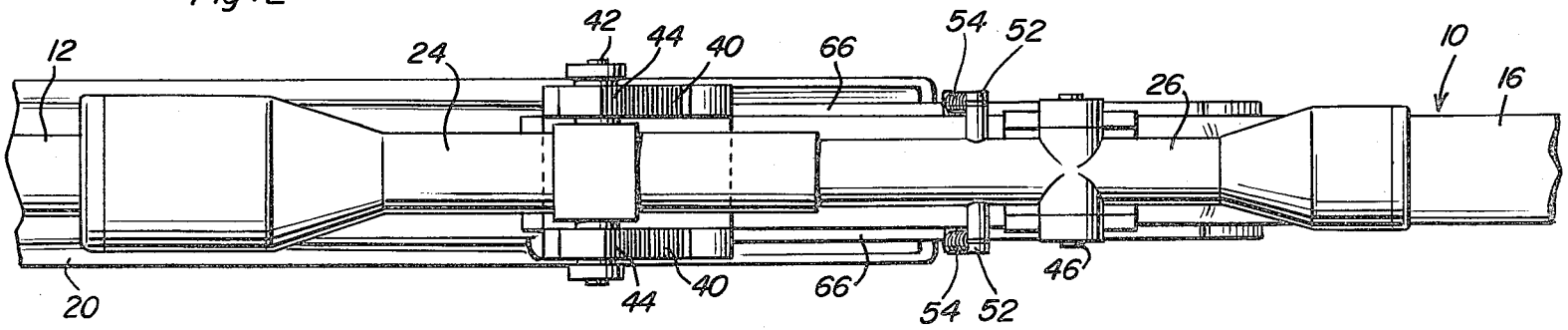
FIG. 2 is a top plan view of the assemblage illustrated in FIG. 1.
Figure 3:
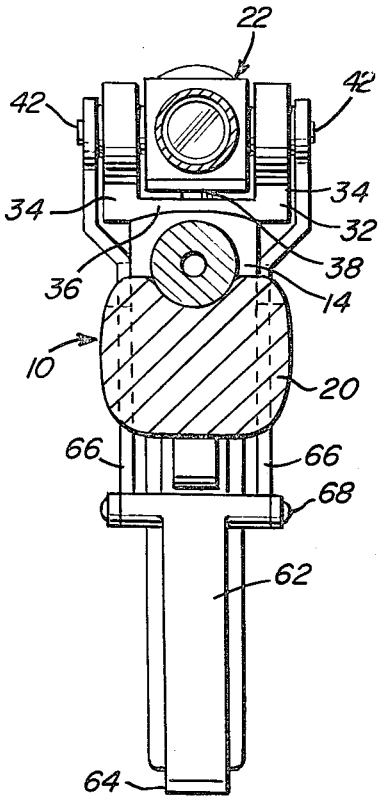
FIG. 3 is a transverse vertical sectional view taken substantially upon the plane indicated by section line 3—3 of FIG. 1.
Figure 4:
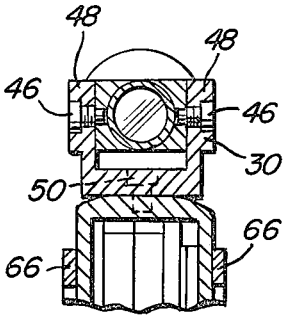
FIG. 4 is a fragmentary transverse vertical sectional view taken substantially upon the plane indicated by section line 4—4 of FIG. 1.

With reference now more specifically to the drawings, the numeral 10 generally designates a long gun in the form of a rifle. The rifle 10 includes a barrel 12 whose rear portion defines a receiver 14. A stock 16 is supported from the rear of the receiver 14 and the rifle 10 further includes a handgrip 18 depending downwardly from the rear of the receiver 14 and a trigger 19 disposed immediately forward of the upper portion of the handgrip 18. The rifle 10 further includes a forward grip 20 underlying the barrel 12 and the telescopic sight of the instant invention is referred to in general by the reference numeral 22 and includes elongated and relatively telescopingly engaged front and rear sections 24 and 26.

The foregoing may be considered as descriptive of at least some conventional forms of rifles and telescopic sights.

The receiver 14 includes longitudinally spaced front and rear mounting structures 28 and 30 supporting the telescopic sight 22 from the receiver 14. The first mounting structure 28 comprises a generally U-shaped channel member 32 including upstanding opposite side flanges 34 interconnected at their lower ends by a horizontal bight portion 36 extending therebetween. The bight portion 36 is removably supported from the forward portion of the receiver 14 by fasteners 38 secured downwardly through the bight portion 36 and threadly engaged with the forward portion of the receiver 14. The upper edges of the flanges 34 are rearwardly and upwardly inclined and include rack gear teeth 40. The opposite sides of the section 24 of the telescopic sight 22 include horizontally outwardly projecting stub axle portions 42 upon which spur gear wheels 44 are rotatably mounted and the gear wheels 44 include toothed peripheral portions meshed with the teeth 40.

The rear section 26 of the sight 22 includes outwardly projecting opposite side stud axles 46 and the mount structure 30 includes upstanding opposite side flanges 48 from which the stub axles 46 are oscillatably supported, the mount structure 30 being secured to the rear portion of the receiver 14 by suitable fasteners 50 corresponding to the fasteners 38. Also, the rear section 26 includes opposite side laterally outwardly projecting pins 52 forward of the stub axles 46 to which the upper ends of a pair of opposite side expansion springs 54 are anchored. The lower ends of the expansion springs 54 are anchored relative to similar opposite side anchor pins 56 supported from and projecting outwardly from opposite sides of the receiver 14. Accordingly, the springs 54 tend to maintain the gear wheels 44 in meshed engagement with the teeth 40.

The lower end of the grip 18 includes a forwardly projecting support plate 60 supported therefrom and the support plate 60 is constructed of shape retentive but bendable material and terminates forwardly in an integral upwardly directed squeeze lever 62, a hinged point 64 for angular displacement of the squeeze lever 62 relative to the support plate 60 being defined at the intersection between plate 60 and the squeeze lever 62. A pair of opposite side force transmitting links 66 are pivotally connected at corresponding lower portions as at 68 to opposite side upper portions of the squeeze lever 62 and are pivotally anchored relative to the stub axle portions 42 at upper forward portions thereof.

Assuming a predetermined type of ammunition is to be utilized in the rifle and the trajectory of that ammunition is known, the inclination of the longitudinal extent of the rack gear teeth 40 is selected in accordance with the amount of longitudinal shifting of the section 24 of the sight 22 relative to the section 26 required to effect focusing of the sight along its optical axis at different ranges from the rifle 10. Of course, although the rack gear teeth 40 are inclined along straight paths, the longitudinal extent of the rack gear teeth may follow an arcuate path which constantly varies in radius of curvature so as to be mated, together with the telescopic sight 22, with the trajectory of the ammunition to be used in the rifle 10. It will be noted that the anchor pins 52 and 56 as well as the expansion springs 54 are disposed in planes spaced inwardly of the planes containing the structures 66. Accordingly, if it is desired to change the mounting structure 28 so as to substitute a similar mounting structure having a different inclination of rack gear teeth 40 thereon, it is merely necessary to pull upwardly on the forward end of the telescopic sight 22 in order that access may be had to the fasteners 38.

Figure 6:
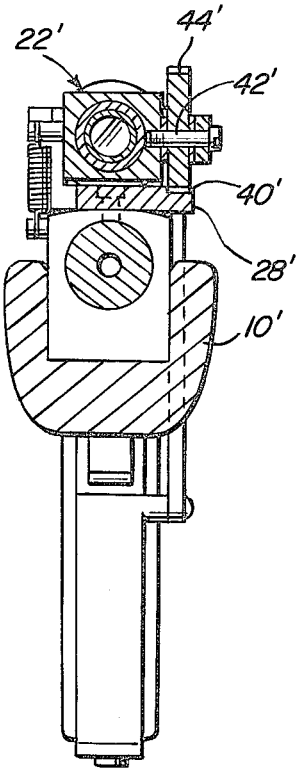
FIG. 6 is a transverse vertical sectional view taken substantially upon the plane indicated by the section line 6—6 of FIG. 5.
Figure 5:
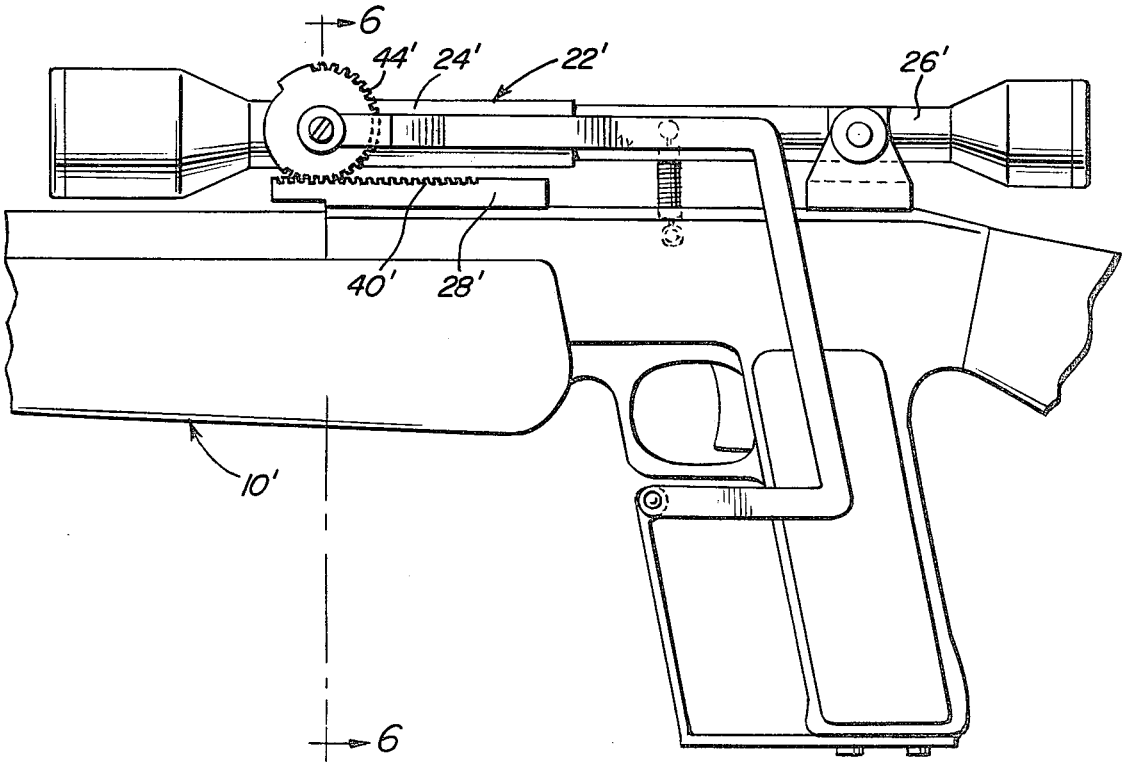
FIG. 5 is a fragmentary side elevational view similar to FIG. 1, but illustrating a modified form of telescopic sight constructed in accordance with the present invention.

With attention now invited more specifically to FIGS. 5 and 6 of the drawings, it will be seen a second rifle 10' equipped with a second telescopic sight 22'. The telescopic sight 22' is operationally equivalent to the telescopic sight 22 and the mounting structure for the telescopic sight 22' is also similar to the mounting structure utilized for the telescopic sight 22. Further, the focusing and "elevation" adjusting mechanism of the assembly illustrated in FIG. 5 is quite similar to the similar components illustrated in FIG. 1 and, accordingly, like parts are designated by corresponding prime reference numerals.

The main difference between the assemblages illustrated in FIGS. 1 and 5 is that the mounting structure 28' in FIG. 5 includes horizontal rack gear teeth 40' and that the front or forward section 24' of the sight 22' includes only a single laterally outwardly projecting stub axle portion 42' upon which a gear wheel 44' of constantly varying effective radius is rotatably mounted. The horizontal rack gear teeth 40' and the gear wheel 44' of constantly varying radius together function in the same manner as the gear teeth 40 and gear wheel 44 whereby rearward displacement of the forward section 24' of the telescopic sight 22' effects elevation of the forward end of the telescopic sight 22'. It will, of course, be noted that rearward displacement of the forward sections 24 and 24' relatively to the rear sections 26 and 26' focus the telescopic sights 22 and 22' at closer distances. In addition, it will be apparent from FIG. 5 of the drawings that the gear wheel 44' may be readily changed in order to "tailor" the telescopic sight 22' for ammunition having different trajectory characteristics to be used in the gun or rifle.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. In combination with a weapon including means for projecting a missile therefrom along a predetermined trajectory path in predetermined orientation relative to said weapon and with said weapon including front and rear mounting points spaced along a reference path generally paralleling said trajectory path, an elongated telescopic sight including front and rear relatively lengthwise shiftable sections for focusing said sight at different range distances, first mounting means mounting said rear section to said rear mounting point for angular displacement relative thereto about a horizontal transverse axis and second mounting means mounting the front section to said front mounting point for vertical and lengthwise shifting relative thereto, a focusing actuator for said sight shiftably supported from said weapon and operatively associated with said sight and said second mounting means for proportionally lengthwise shifting said front section relative to said rear section and vertically shifting said front section relative to said second mounting means in a manner whereby the focused range on the optical axis of the telescopic sight is disposed at the same elevation as the same range distance along said trajectory path from said weapon.

2. The combination of claim 1 wherein said weapon includes a handgrip portion and said actuator includes a trigger portion shiftable relative to said handgrip portion.

3. The combination of claim 1 wherein said second mounting means includes a pair of laterally spaced inclined rack gears disposed on opposite sides of a vertical plane containing said optical axis, said front section including a pair of opposite side lateral axle portions and a pair of gear wheels journeled on said axle portions and meshed with said rack gear, said actuator being operably connected to each of said axle portions.

4. The combination of claim 1 including yieldable spring means operably connected between said weapon and said telescopic sight intermediate said first and second mounting means and yieldingly biasing said sight in a direction to swing said second section toward said weapon.

5. In combination with a weapon including means for projecting a missile therefrom along a predetermined trajectory path in predetermined orientation relative to said weapon and with said weapon including front and rear mounting points spaced along a reference path generally paralleling said trajectory path, an elongated telescopic sight including front and rear relatively lengthwise shiftable sections for focusing said sight at different range distances, first mounting means mounting said rear section to said rear mounting point for angular displacement relative thereto about a horizontal transverse axis and second mounting means mounting the front section to said front mounting point for vertical and lengthwise shifting relative thereto, a focusing actuator for said sight shiftably supported from said weapon and operatively associated with said sight and said second mounting means for proportionally lengthwise shifting said front section relative to said rear section and vertically shifting said front section relative to said second mounting means in a manner whereby the focused range on the optical axis of the telescopic sight is disposd at the same elevation as the same range distance along said trajectory path from said weapon, said second mounting means including an inclined rack gear mounted on said second mounting point, a lateral axle portion supported from said front section and a gear wheel journaled on said axle portion and meshed with said rack gear, said focusing actuator being shiftably supported from said weapon for shifting along a path extending lengthwise of said sight and operably connected to said axle portion for similar shifting thereof, said weapon including a handgrip portion and said actuator includes a trigger portion shiftable relative to said handgrip portion.

6. In combination with a weapon including means for projecting a missile therefrom along a predetermined trajectory path in predetermined orientation relative to said weapon and with said weapon including front and rear mounting points spaced along a reference path generally paralleling said trajectory path, an elongated telescopic sight including front and rear relatively lengthwise shiftable sections for focusing said sight at different range distances, first mounting means mounting said rear section to said rear mounting point for angular displacement relative thereto about a horizontal transverse axis and second mounting means mounting the front section to said front mounting point for vertical and lengthwise shifting relative thereto, a focusing actuator for said sight shiftably supported from said weapon and operatively associated with said sight and said second mounting means for proportionally lengthwise shifting said front section relative to said rear section and vertically shifting said front section relative to said second mounting means in a manner whereby the focused range on the optical axis of the telescopic sight is disposed at the same elevation as the same range distance along said trajectory path from said weapon, said second mounting means including a generally horizontal rack gear mounted on said front mounting point, a lateral axle portion supported from said front section and a gear wheel journaled on said axle portion and meshed with said rack gear, circumferentially spaced portions of said gear wheel being spaced different radial distances from the axis of rotation of said gear wheel, said focusing actuator being shiftably supported from said weapon for shifting along a path extending lengthwise of said sight and operably connected to said axle portion for similar shifting thereof.

7. The combination of claim 6 wherein said weapon includes a handgrip portion and said actuator includes a trigger portion shiftable relative to said handgrip portion.

* * * * *